US007963404B2

(12) United States Patent
Shang

(10) Patent No.: US 7,963,404 B2
(45) Date of Patent: Jun. 21, 2011

(54) COMBINED SHOE RACK

(76) Inventor: Kuo-Wen Shang, Dadu Township, Taichung County (TW)

( * ) Notice: Subject to any disclaimer, the term of this patent is extended or adjusted under 35 U.S.C. 154(b) by 100 days.

(21) Appl. No.: 12/502,757

(22) Filed: Jul. 14, 2009

(65) Prior Publication Data

US 2010/0282696 A1 Nov. 11, 2010

(30) Foreign Application Priority Data

May 5, 2009 (TW) ..... 98207652 U

(51) Int. Cl.
*A47F 7/08* (2006.01)

(52) U.S. Cl. ..... 211/36; 211/181.1; 211/182

(58) Field of Classification Search ..... 211/34, 211/36–38, 186, 188, 194, 150, 189, 181.1, 211/182, 184; 206/293, 278, 523; 190/16; 220/531, 23.6
See application file for complete search history.

(56) References Cited

U.S. PATENT DOCUMENTS

| | | | | | |
|---|---|---|---|---|---|
| 888,774 | A * | 5/1908 | Wood | 229/100 |
| 1,531,818 | A * | 3/1925 | Ryerson | 220/487 |
| 1,700,432 | A * | 1/1929 | Cahill | 229/120.35 |
| 1,921,110 | A * | 8/1933 | Wheary | 206/293 |
| 2,104,828 | A * | 1/1938 | Brinnon | 206/278 |
| 4,546,887 | A * | 10/1985 | Cohn | 211/49.1 |
| 4,700,640 | A * | 10/1987 | Andersson | 111/186 |
| 4,976,375 | A * | 12/1990 | Quam | 220/534 |
| 6,732,858 | B1 * | 5/2004 | Chang Ou | 206/278 |
| 7,661,536 | B2 * | 2/2010 | Voswinkel | 206/762 |
| 2004/0134869 | A1 * | 7/2004 | Yang et al. | 211/181.1 |

* cited by examiner

*Primary Examiner* — Korie Chan
(74) *Attorney, Agent, or Firm* — Wang Law Firm, Inc.; Li K. Wang

(57) ABSTRACT

A combined shoe rack comprises a combined frame and at least one movable spacer plate. The combined frame is defined with at least one holding groove. The movable spacer plate is disposed in the holding groove of the combined frame, and an edge of the movable spacer plate is pivotally combined to an inner edge of the holding groove in such a manner that the movable spacer plate can be pivoted about the inner edge of the holding groove within the holding groove. When the movable spacer plate is pivoted to incline along a diagonal plane of the holding groove, the holding groove will be divided into a first chamber and a second chamber both of which are triangular in cross section, so that one holding groove can hold two pairs of lower shoes or a pair of higher shoes, thus making full use of space to hold more shoes.

8 Claims, 10 Drawing Sheets

COMBINED SHOE RACK

BACKGROUND OF THE INVENTION

1. Field of the Invention

The present invention relates to a shoe rack, and more particularly to a combined shoe rack which is provided with a movable spacer plate in a holding groove thereof to enable the same holding groove to hold two pairs of shoes at the same time.

2. Description of the Prior Art

Most of the people have several pairs of shoes worn with different clothes or in different occasions. In order to keep unused shoes tidy, beautiful and ventilated, shoe racks are normally used. However, the conventional shoe racks are all simple in structure and just divided into plural layers by layer plates for holding shoes in a vertical layered manner, so its useful storage space is limited. Actually, the conventional shoe racks still have a lot of space that has not been used yet. Hence, how to make full use of space to hold more shoes is the improvement of the present invention.

The present invention has arisen to mitigate and/or obviate the afore-described disadvantages.

SUMMARY OF THE INVENTION

The technical problems to be solved:

The conventional shoe racks all hold shoes in a vertical layered manner, so a lot of space hasn't been used after placement of shoes. Hence, how to make full use of space to store more shoes is the technical problem to be solved.

The technical features for solving the above technical problems:

The present invention provides a combined shoe rack comprising a combined frame and at least one movable spacer plate. The combined frame is defined with at least one holding groove. The movable spacer plate is disposed in the holding groove of the combined frame, and an edge of the movable spacer plate is pivotally combined to an inner edge of the holding groove in such a manner that the movable spacer plate can be pivoted about the inner edge of the holding groove within the holding groove. When the movable spacer plate is pivoted to incline along a diagonal plane of the holding groove, the holding groove will be divided into a first chamber and a second chamber both of which are triangular in cross section.

The present invention has the following advantages:

The primary objective of the present invention is to provide a combined shoe rack provided with a movable spacer plate in the respective holding grooves of the combined frame to make full use of space. The movable spacer plate has an edge pivotally combined to an inner edge of the holding groove, so that the movable spacer plate can be pivoted about the inner edge of the holding groove within the holding groove. By such arrangements, the movable spacer plate can be pivoted to horizontal position to provide a space of the whole holding groove for storing a pair of higher shoes or to incline along a diagonal plane of the holding groove to divide the holding groove into two chambers for storing two pairs of lower shoes, thus achieving the objective of making full use of space to hold more shoes.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
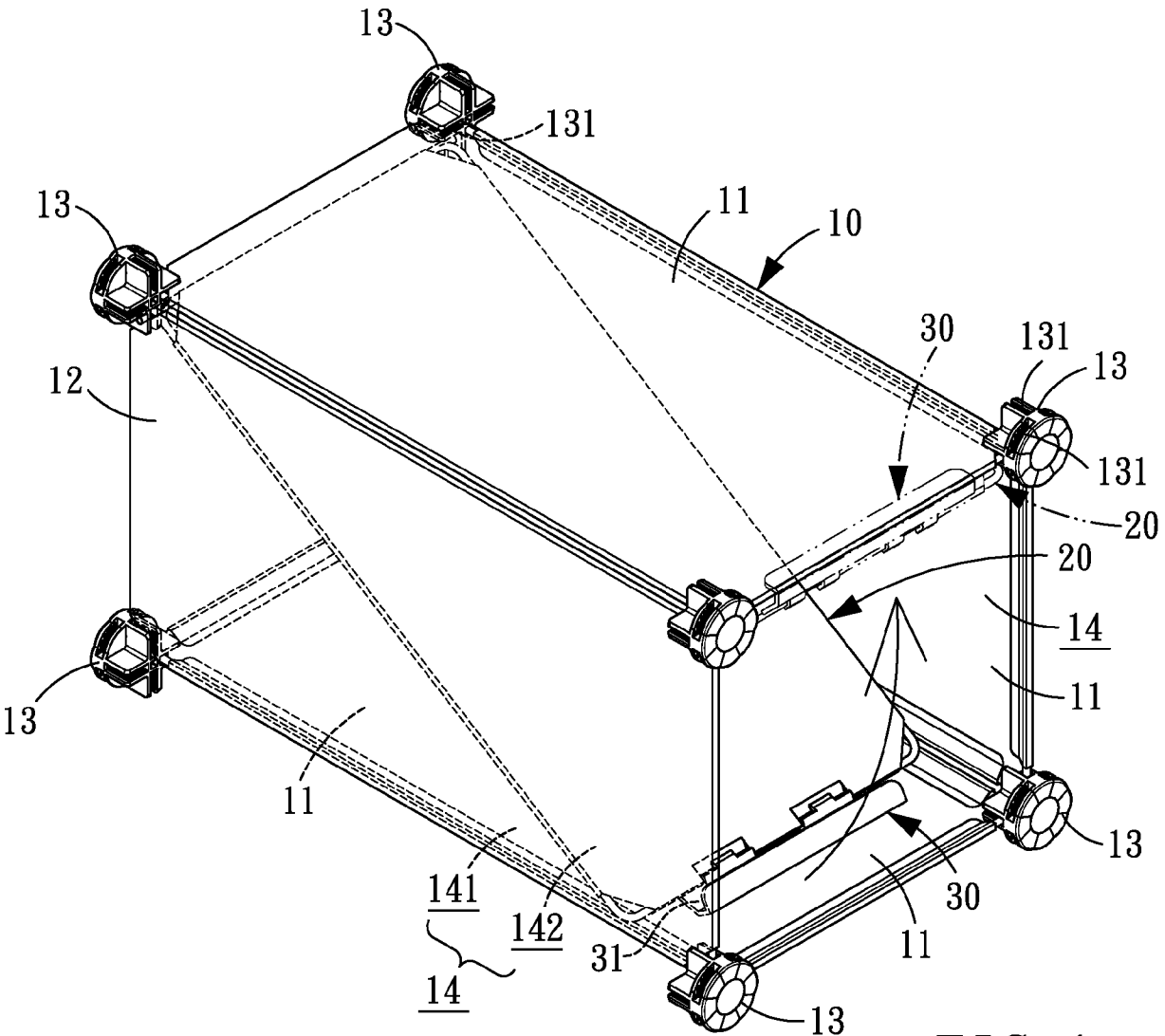
FIG. 1 is a perspective view of a combined shoe rack in accordance with a first embodiment of the present invention.
Figure 2:
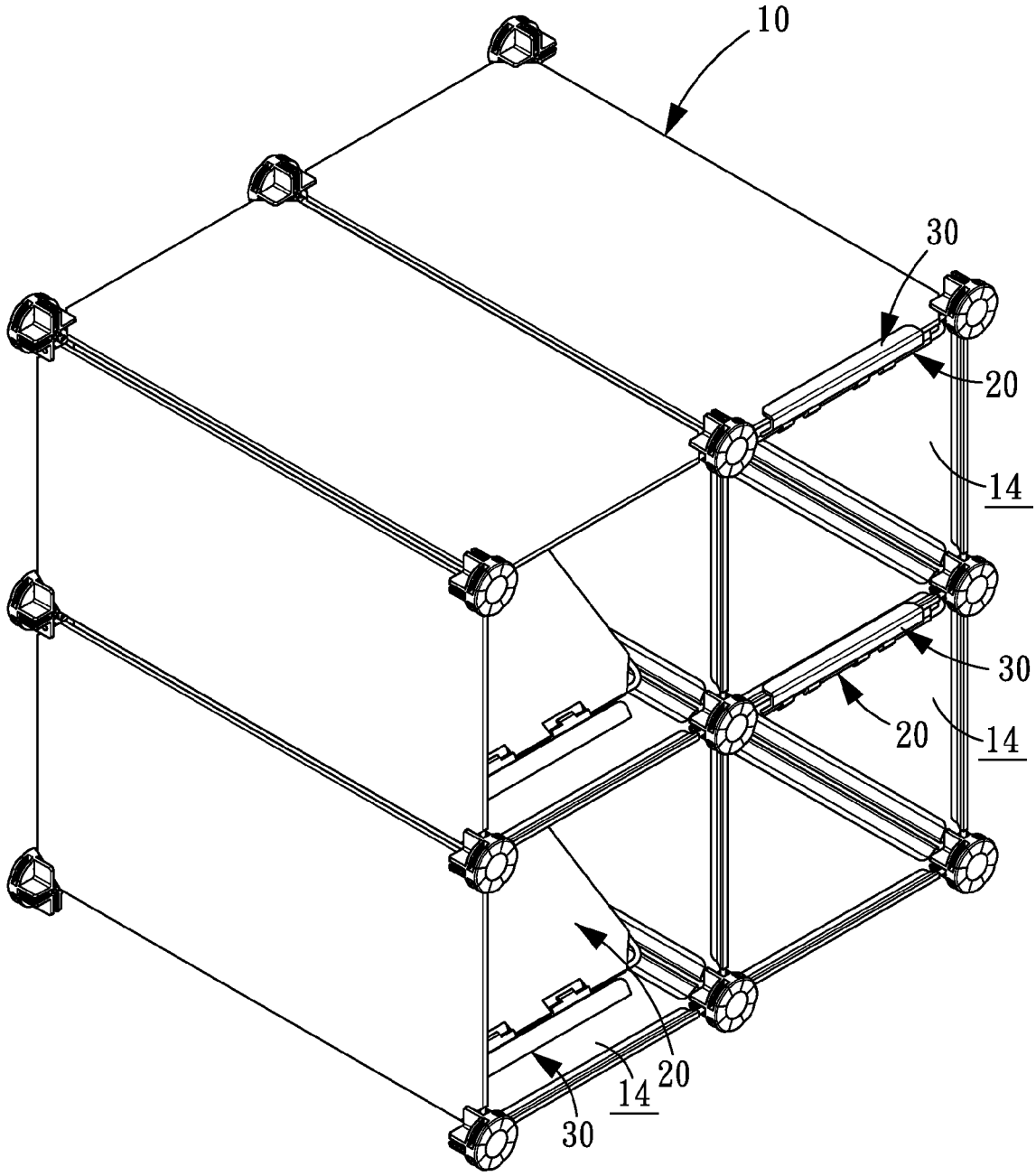
FIG. 2 is a perspective view showing the combined frame in accordance with the first embodiment of the present invention includes plural holding grooves and plural movable spacer plates.

Please refer to FIGS. 1 and 2 first, a combined shoe rack in accordance with a first embodiment of the present invention comprises a combined frame 10, at least one movable spacer plate 20 and at least one positioning member 30. The combined frame 10 includes plural side plates 11, at least one back plate 12 and plural engaging members 13. The combined frame 10 is defined with at least one holding groove 14. The plural side plates 11 are arranged around the holding groove 14, and the back plate 12 is located at a bottom of the holding groove 14. The back plate 12 is connected to the respective side plates 11 around the holding groove 14. The respective engaging members 13 are defined with plural engaging grooves 131 corresponding to corners of both the side plates 11 and the back plate 12. The engaging members 13 are disposed at the respective corners of the combined frame 10 in such a manner that the respective corners of both the side plates 11 and the back plate 12 are engaged into the respective engaging grooves 131 of the engaging members 13. The positioning member 30 is combined on the movable spacer plate 20 and located correspondingly to an opening of the holding groove 14. The positioning member 30 can pivot on the movable spacer plate 20 and is provided with a fastening portion 31.

The movable spacer plate 20 is disposed in the holding groove 14 of the combined frame 10, and an edge of the movable spacer plate 20 is pivotally coupled to an inner edge of the holding groove 14 in such a manner that the movable spacer plate 20 can be pivoted about the inner edge of the holding groove 14 within the holding groove 14. When the movable spacer plate 20 is pivoted within the holding groove 14 to incline along a diagonal plane of the holding groove 14, the holding groove 14 will be divided into a first chamber 141 and a second chamber 142 that are triangular in cross section. When the movable spacer plate 20 is pivoted within the holding groove 14 to a horizontal position, the fastening portion 31 of the positioning member will be fastened to one of the side plates 11.

The holding groove 14 of the combined frame 10 can be provided for holding a pair of higher shoes. The holding groove 14 can also be divided into the first chamber 141 and the second chamber 142 by the movable spacer plate 20, and the respective chambers 141, 142 are provided for holding a pair of lower shoes, so that one holding groove 14 can hold two pairs of lower shoes.

Figure 3:
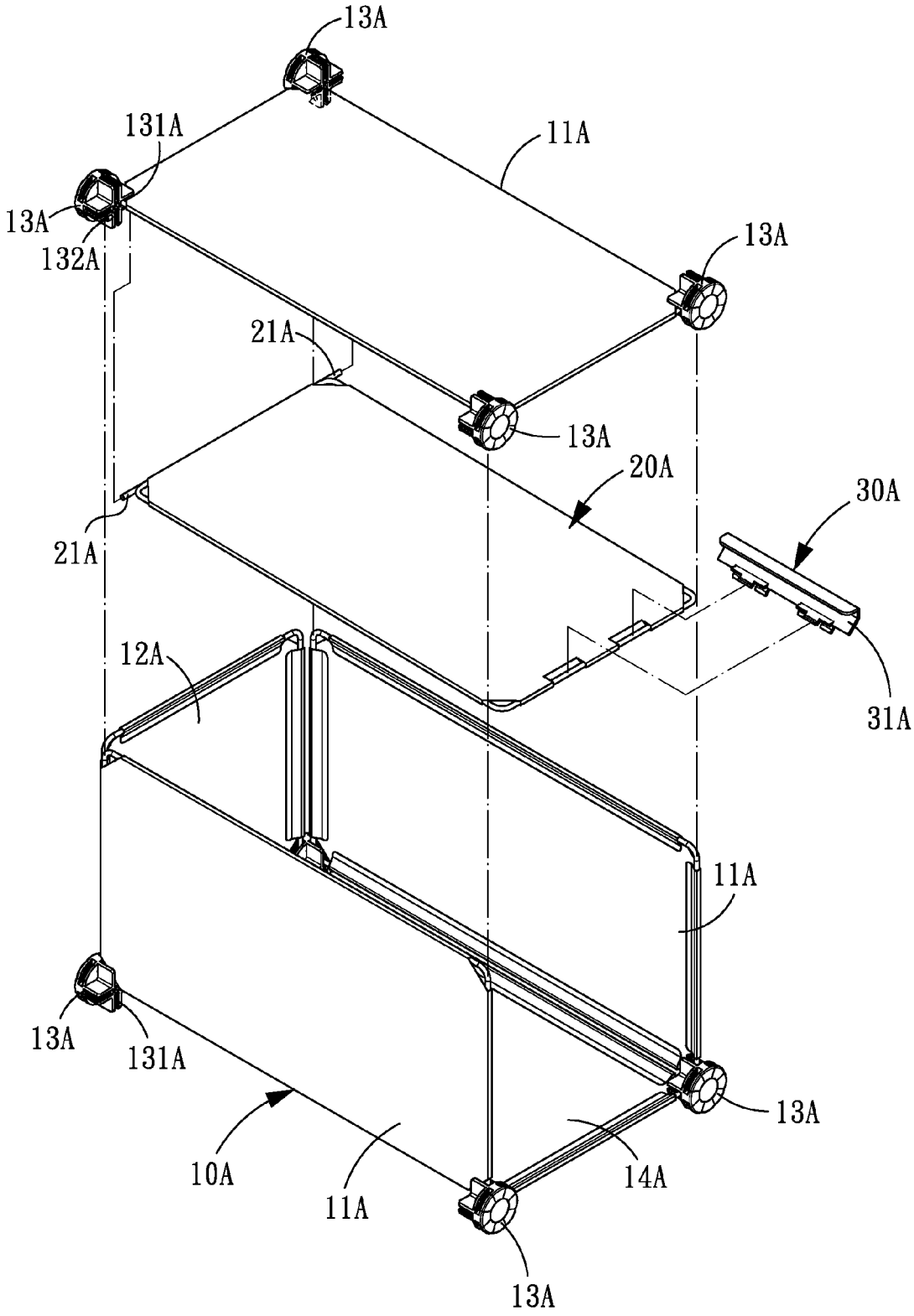
FIG. 3 is an exploded view of a combined shoe rack in accordance with a second embodiment of the present invention.
Figure 4:
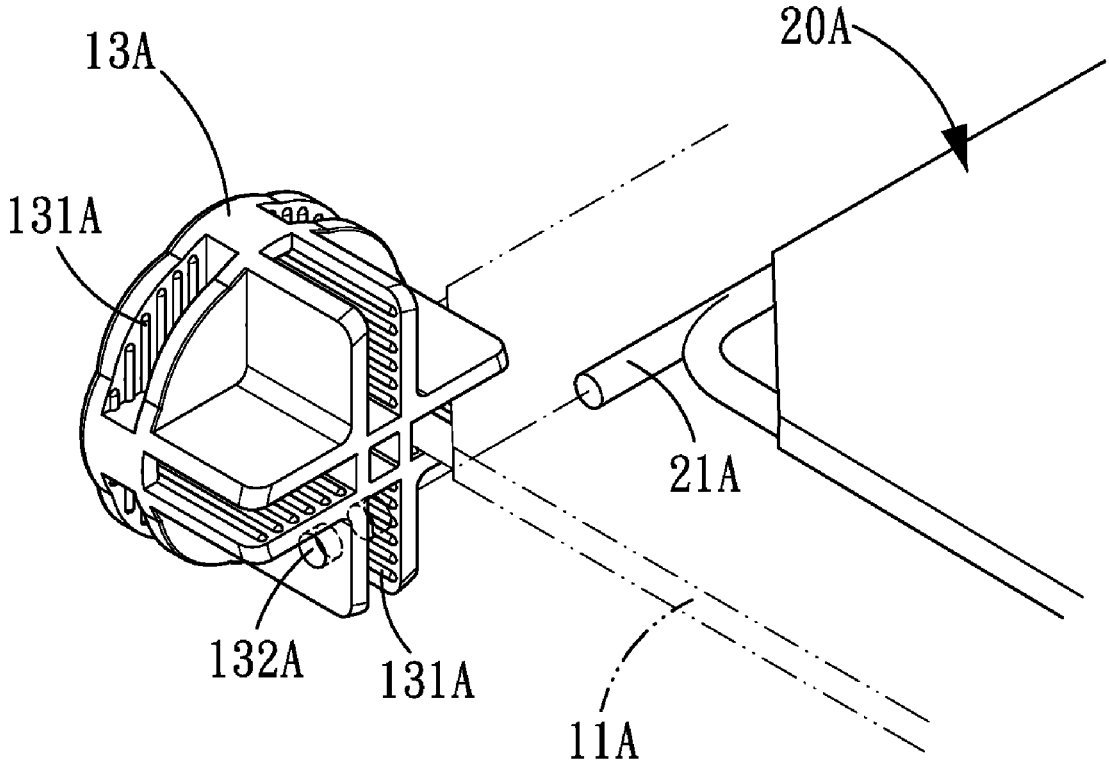
FIG. 4 is a partial enlarged view of the combined shoe rack of FIG. 3.
Figure 5:
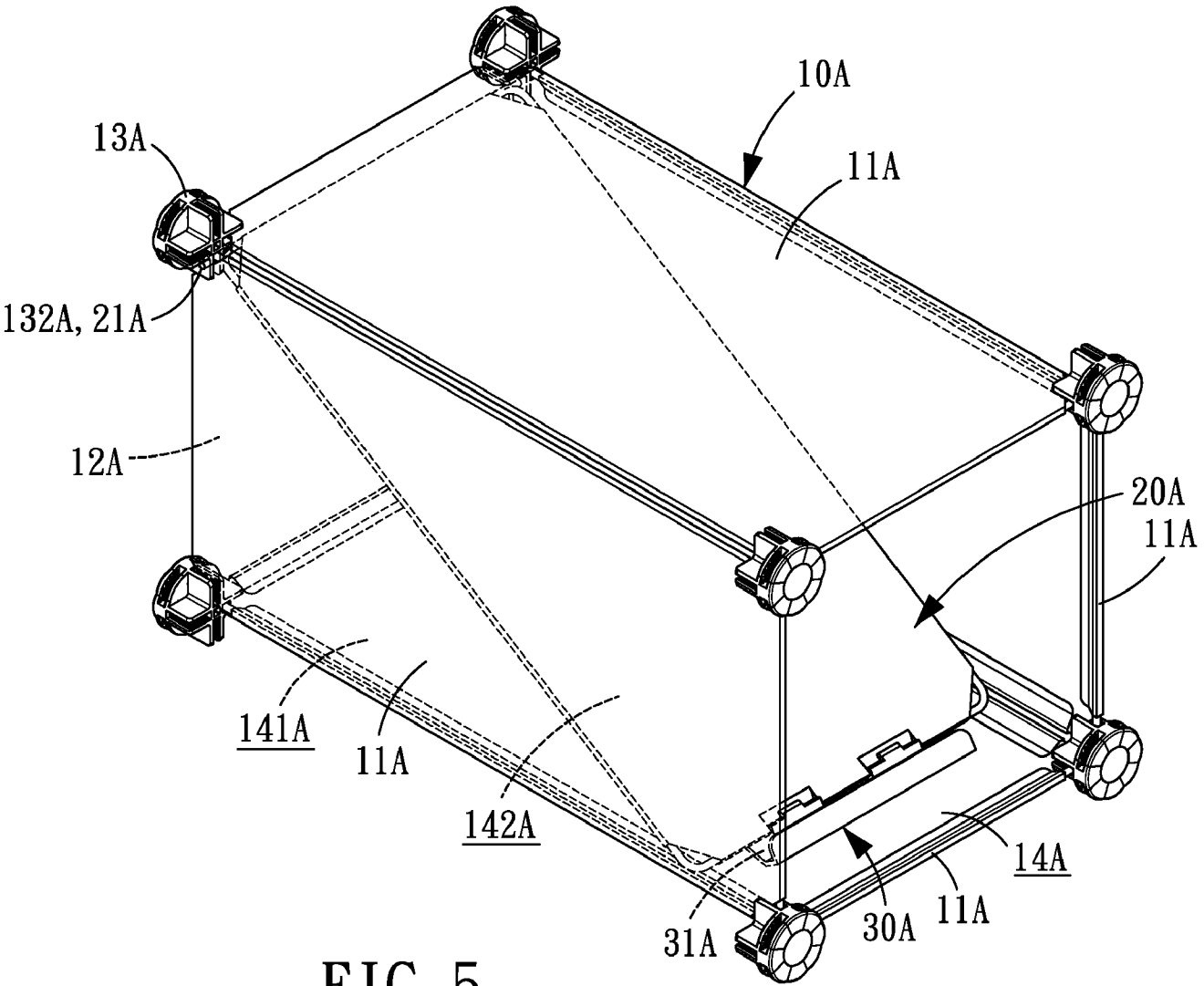
FIG. 5 is a perspective assembly view of the combined shoe rack in accordance with the second embodiment of the present invention.
Figure 6:
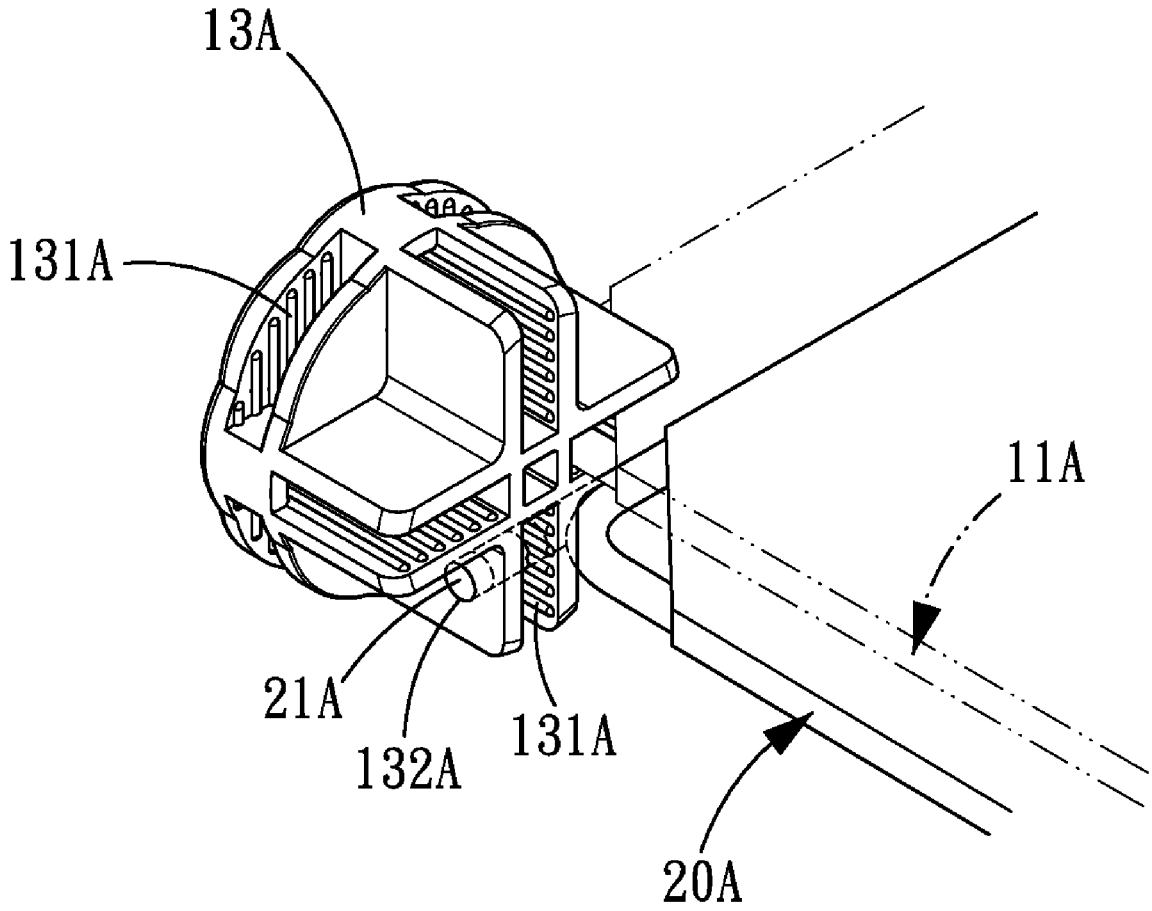
FIG. 6 is a partial enlarged view of the combined shoe rack of FIG. 5.

Next referring to FIG. 3, a combined shoe rack in accordance with a second embodiment of the present invention comprises a combined frame 10A, at least one movable spacer plate 20A and at least one positioning member 30A. The combined frame 10A includes plural side plates 11A, at least one back plate 12A and plural engaging members 13A. The combined frame 10A is defined with at least one holding groove 14A. The plural side plates 11A are arranged around the holding groove 14A, and the back plate 12A is located at a bottom of the holding groove 14A. The back plate 12A is connected to the respective side plates 11A around the holding groove 14A. The respective engaging members 13A are defined with plural engaging grooves 131A corresponding to corners of both the side plates 11A and the back plate 12A. The engaging members 13A are disposed at the respective corners of the combined frame 10A in such a manner that the respective corners of both the side plates 11A and the back plate 12A are engaged into the respective engaging grooves 131A of the engaging members 13A. Referring to FIG. 4 in detail, at each of two opposite ends of one of the inner edges of the holding groove 14A is provided a pivot hole 132A, and the two pivot holes 132A are defined in two of the engaging members 13A. The movable spacer plate 20A is provided with a pivot pin 21A at each of two opposite ends of one of edges thereof and is disposed in the holding groove 14A with the two pivot pins 21A being inserted into the pivot holes 132A, as shown in FIGS. 5 and 6, so that the movable spacer plate 20A can be pivoted about the pivot holes 132A. When the movable spacer plate 20A is pivoted within the holding groove 14A to incline along a diagonal plane of the holding groove 14A, the holding groove 14A will be divided into a first chamber 141A and a second chamber 142A that are triangular in cross section.

The positioning member 30A is combined on the movable spacer plate 20A and located correspondingly to an opening of the holding groove 14A. The positioning member 30A can pivot on the movable spacer plate 20A and is provided with a fastening portion 31A.

Figure 7:
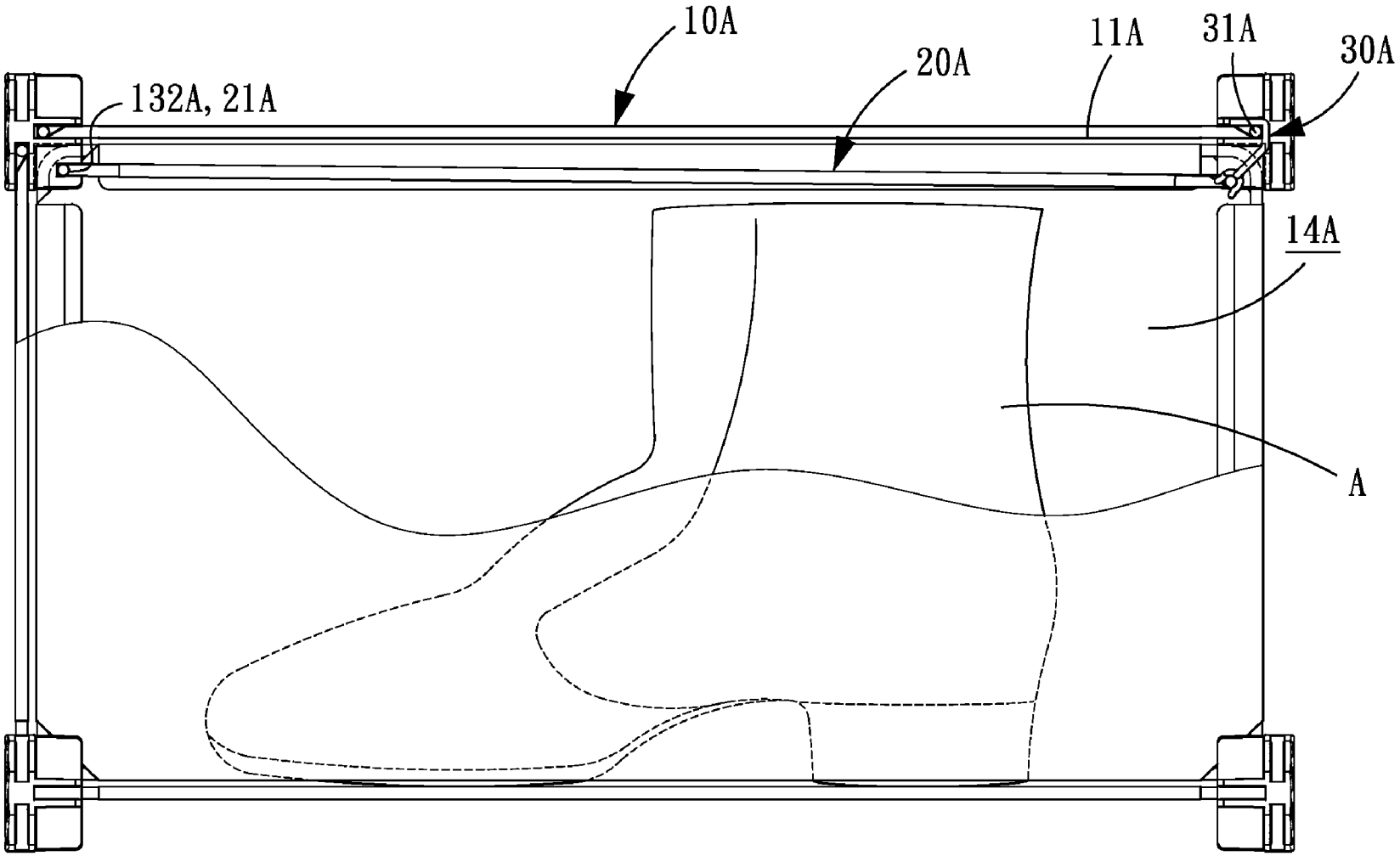
FIG. 7 is a side view showing that the combined shoe rack in accordance with the present invention is provided for holding a pair of higher shoes.
Figure 8:
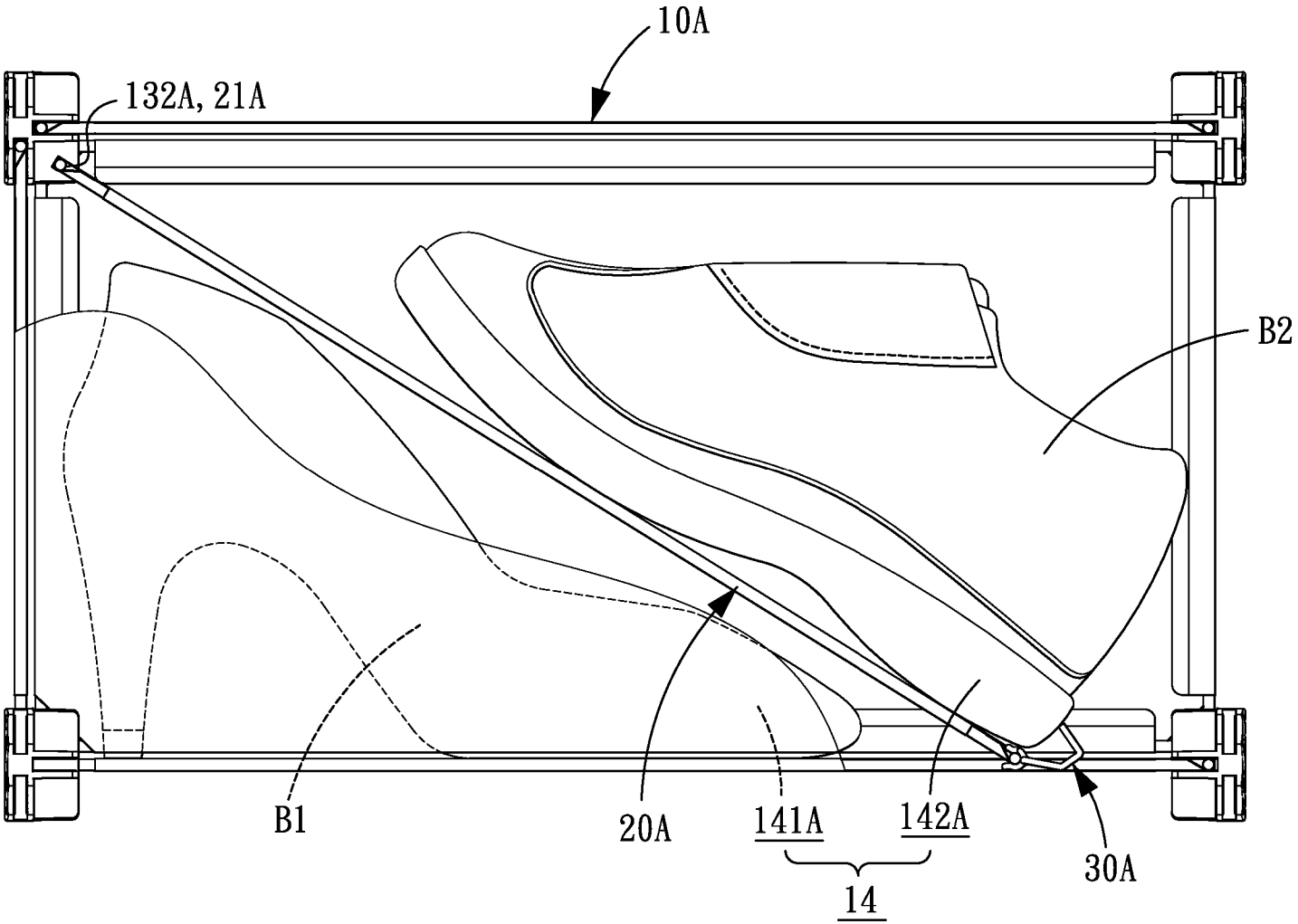
FIG. 8 is a side view showing that the combined shoe rack in accordance with the present invent is provided for holding two pairs of lower shoes.

As shown in FIG. 7, when the combined shoe rack in accordance with the second embodiment of the present invention is intended to hold a pair of higher shoes A, the movable spacer plate 20A will be pivoted within the holding groove 14A to a horizontal position and then fastened to the corresponding side plate 11A by the fastening portion 31A of the positioning member 30A to provide a largest independent space for holding the pair of higher shoes A. As shown in FIG. 8, when the combined shoe rack in accordance with the second embodiment of the present invention is intended to hold two pairs of lower shoes B1, B2, the movable spacer plate 20A will be pivoted to incline along the diagonal plane of the holding groove 14A to divide the holding groove 14A into the first chamber 141A and the second chamber 142A for holding the two pairs of lower shoes B1, B2, respectively. At this moment, the positioning member 30 supports against a lower part of the outside slantways-arranged pair of shoes B2 for avoiding the slippage of the pair of shoes B2.

Figure 9:
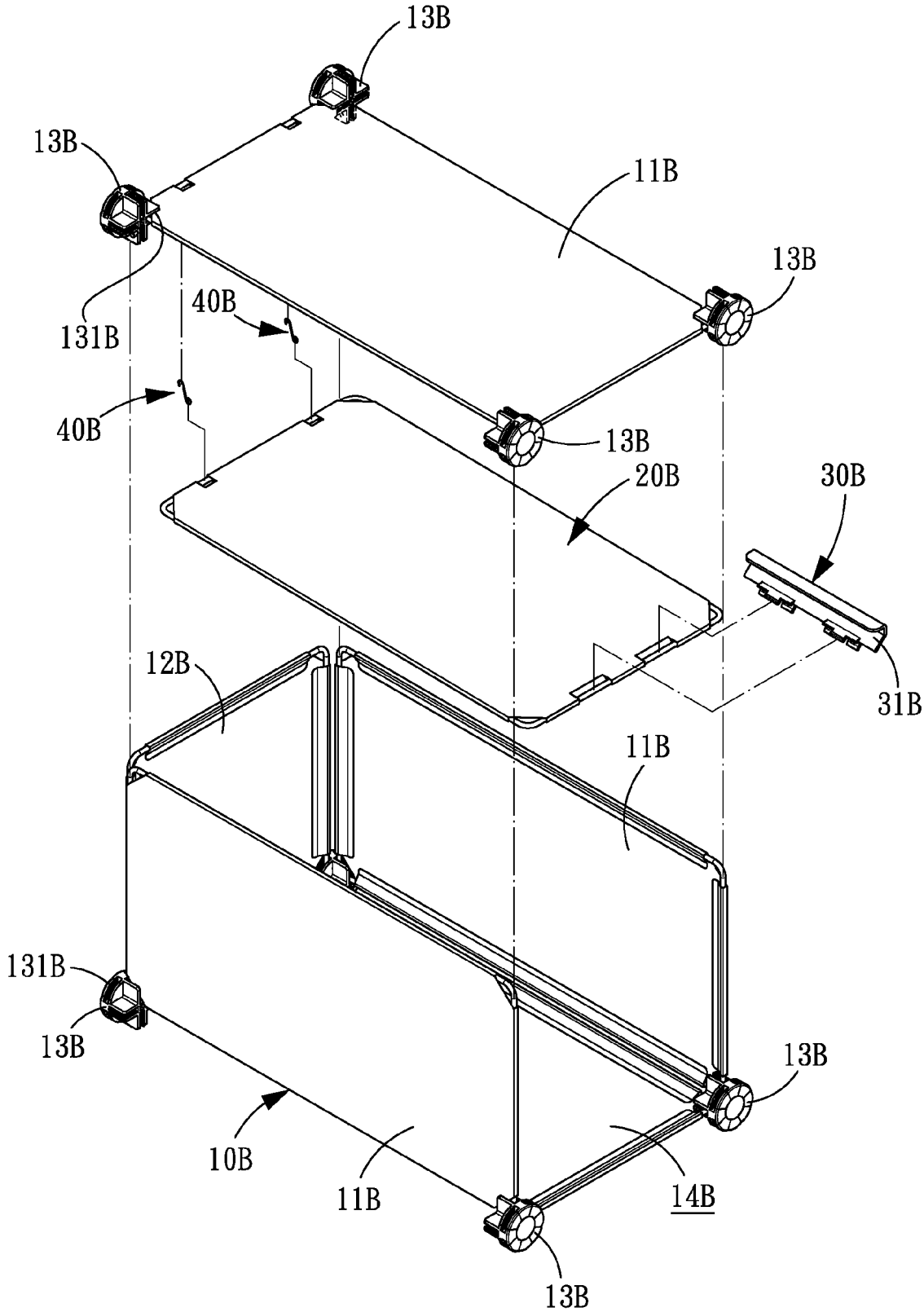
FIG. 9 is a perspective exploded view of a combined shoe rack in accordance with a third embodiment of the present invention.
Figure 10:
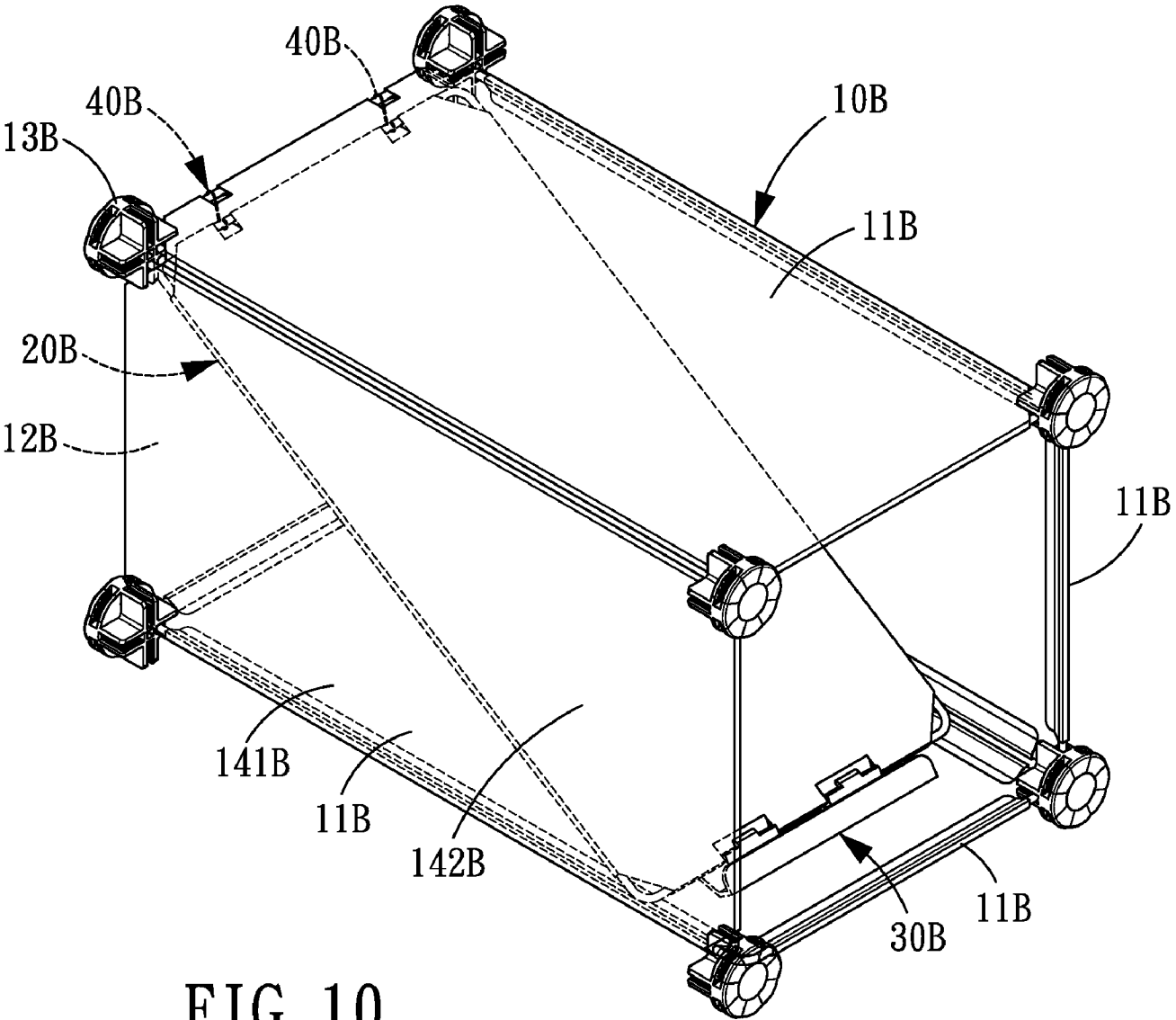
FIG. 10 is a perspective assembly view of the combined shoe rack in accordance with the third embodiment of the present invention.

Further referring to FIGS. 9 and 10, a combined shoe rack in accordance with a third embodiment of the present invention comprises a combined frame 10B, at least one movable spacer plate 20B and at least one positioning member 30B. The combined frame 10B includes plural side plates 11B, at least one back plate 12B and plural engaging members 13B. The combined frame 10B is defined with at least one holding groove 14B. The plural side plates 11B are arranged around the holding groove 14B, and the back plate 12B is located at a bottom of the holding groove 14B. The back plate 12B is connected to the respective side plates 11B around the holding groove 14B. The respective engaging members 13B are defined with plural engaging grooves 131B corresponding to corners of both the side plates 11B and the back plate 12B. The engaging members 13B are disposed at the respective corners of the combined frame 10B in such a manner that the respective corners of both the side plates 11B and the back plate 12B are engaged into the respective engaging grooves 131B of the engaging members 13B. The movable spacer plate 20B is disposed in the holding groove 14B of the combined frame 10B, and at least two S-shaped connecting members 40B are connected between one of the edges of the movable spacer plate 20B and one of the inner edges of the holding groove 14B in such a manner one end of the respective S-shaped connecting members 40B is connected to the one of the edges of the movable spacer plate 20B, and the other end of the respective S-shaped connecting members 40B is connected to the one of the inner edges of the holding groove 14B. The side plates 11B and the back plate 12B each are provided around an outer periphery thereof with a metal frame for connecting to both ends of the respective S-shaped connecting members 40B, so that the movable spacer plate 20B can be pivoted about one of the inner edges of the holding groove 14B. When the movable spacer plate 20B is pivoted to incline along a diagonal plane of the holding groove 14B, the holding groove 14B will be divided into a first chamber 141B and a second chamber 142B that are triangular in cross section.

The positioning member 30B is combined on the movable spacer plate 20B and located correspondingly to an opening of the holding groove 14B. The positioning member 30B can pivot on the movable spacer plate 20B and is provided with a fastening portion 31B.

As known from the above embodiments, the present invention has the following advantages: by pivotally disposing a movable spacer plate 20 (20A or 20B) into the holding groove 14 (14A or 14B) of the combined frame 10 (10A or 10B), the movable spacer plate can be pivoted to provide a largest space in the holding groove 14 (14A or 14B) for holding a pair of higher shoes A or divide the holding groove 14 (14A or 14B) into two smaller chambers 141, 142 for holding two pairs of lower shoes B1, B2, so that the combined shoe rack of the present invention can make full use of space and utilize the same space to hold more pairs of shoes.

While we have shown and described various embodiments in accordance with the present invention, it is clear to those skilled in the art that further embodiments may be made without departing from the scope of the present invention.

What is claimed is:

1. A combined shoe rack comprising a combined frame, at least one movable spacer plate and at least one positioning member; wherein:

the combined frame includes plural side plates and plural engaging members and is defined with at least one holding groove, the side plates are arranged around the holding groove, the respective engaging members are defined with plural engaging grooves corresponding to corners of the side plates, the respective engaging members are disposed at corners of the combined frame, the corners of the side plates are engaged into the respective engaging grooves, at each of two opposite ends of one of inner edges of the holding grooves is provided a pivot hole;

the movable spacer plate is provided at each of two opposite ends of one of edges thereof with a pivot pin, the movable spacer plate is disposed in the holding groove of the combined frame, the two pivot pins are inserted into the respective pivot holes to allow the movable spacer plate to be pivoted about the pivot holes, when the movable spacer plate is pivoted within the holding groove to incline along a diagonal plane of the holding groove, the holding groove will be divided into a first chamber and a second chamber both of which are triangular in cross section;

the positioning member is combined on the movable spacer plate and located correspondingly to an opening of the holding groove, the positioning member is allowed to pivot on the movable spacer plate and provided with a fastening portion, when the movable spacer plate is pivoted within the holding groove to a horizontal position, the fastening portion of the positioning member will be fastened to one of the side plates; and shoes are held in the holding groove, the first chamber or the second chamber.

2. The combined shoe rack as claimed in claim 1, wherein the combined frame further includes at least one back plate, the back plate is located at a bottom of the holding groove and connected to the respective side plates around the holding groove, the back plate has corners engaged into the engaging grooves of the engaging members.

3. The combined shoe rack as claimed in claim 1, wherein the pivot holes are defined in two of the engaging members.

4. A combined shoe rack comprising a combined frame, at least one movable spacer plate, at least one positioning member and plural connecting members; wherein:

the combined frame includes plural side plates and plural engaging members and is defined with at least one holding groove, the side plates are arranged around the holding groove, the respective engaging members are defined with plural engaging grooves corresponding to corners of the side plates, the respective engaging members are disposed at corners of the combined frame, the corners of the side plates are engaged into the respective engaging grooves, the movable spacer plate is disposed in the holding groove of the combined frame, one end of the respective connecting members is connected to one of edges of the movable spacer plate, and the other end of the respective connecting members is connected to one of inner edges of the holding groove, so that the movable spacer is allowed to pivot about the one of the inner edges of the holding groove, when the movable spacer plate is pivoted within the holding groove to incline along a diagonal plane of the holding groove, the holding groove will be divided into a first chamber and a second chamber both of which are triangular in cross section;

the positioning member is combined on the movable spacer plate and located correspondingly to an opening of the holding groove, the positioning member is allowed to pivot on the movable spacer plate and provided with a fastening portion;

the positioning member is combined on the movable spacer plate and located correspondingly to an opening of the holding groove, the positioning member is allowed to pivot on the movable spacer plate and provided with a fastening portion, when the movable spacer plate is pivoted to within the holding groove to a horizontal position, the fastening portion of the positioning member will be fastened to one of the side plates; and shoes are held in the holding groove, the first chamber or the second chamber.

5. The combined shoe rack as claimed in claim 4, wherein the side plates each are provided around an outer periphery thereof with a metal frame for connecting to the respective connecting members.

6. The combined shoe rack as claimed in claim 4, wherein the respective connecting members are S-shaped.

7. The combined shoe rack as claimed in claim 5, wherein the respective connecting members are S-shaped.

8. The combined shoe rack as claimed in claim 4, wherein the combined frame further includes a back plate, the back plate is located at a bottom of the holding groove and connected to the respective side plates around the holding groove, the back plate has corners engaged into the engaging grooves of the engaging members.

* * * * *